US005598586A

United States Patent [19]

Munjone

[11] Patent Number: 5,598,586

[45] Date of Patent: Feb. 4, 1997

[54] ATHLETIC SHORTS WITH INNER AND OUTER LAYERS

[76] Inventor: Deon C. Munjone, 9353 NE. Viewcrest, Bainbridge Island, Wash. 98110

[21] Appl. No.: 523,777

[22] Filed: Sep. 5, 1995

[51] Int. Cl.[6] ..... A41D 1/06

[52] U.S. Cl. ..... 2/237; 2/228; 2/238

[58] Field of Search ..... 2/237, 238, 227, 2/228, 67, 69, 400, 401, 403, 406, 128, 76, 220, 221, 270

[56] References Cited

U.S. PATENT DOCUMENTS

| | | | |
|---|---|---|---|
| D. 313,692 | 1/1991 | Karn | D2/42 |
| 1,402,320 | 1/1922 | Sheen | 2/270 |
| 2,034,312 | 3/1936 | Rubin | 2/228 |
| 2,446,326 | 8/1948 | Guithes | 2/238 |
| 4,894,867 | 1/1990 | Ceravolo et al. | 2/227 |
| 5,052,058 | 10/1991 | Mueller | 2/227 |
| 5,136,727 | 8/1992 | Brisco | 2/228 |

*Primary Examiner*—C. D. Crowder
*Assistant Examiner*—Gloria Hale

[57] ABSTRACT

Athletic shorts with inner and outer layers comprising: an outer shell fabricated of synthetic materials and including an upper region with an open uppermost extent, the upper region having a front section including a vertical slit with coupling devices and an adjustable strap, the lower region of the outer shell including two legs formed in a generally cylindrical configuration with an open lowermost extent having a perimeter and a front section, each front section including an adjustable strap positioned adjacent to the perimeter; and an inner sports brief fabricated of synthetic materials and positioned inside the outer shell, the sports brief being smaller than and having the same shape as the outer shell, the sports brief having an uppermost extent affixed to the uppermost extent of the outer shell, the sports brief having a lower section comprising two legs, each leg having an open lowermost extent with a perimeter including a elastic strip.

5 Claims, 3 Drawing Sheets

ATHLETIC SHORTS WITH INNER AND OUTER LAYERS

BACKGROUND OF THE INVENTION

1. Field of the Invention

The present invention relates to athletic shorts with inner and outer layers and more particularly pertains to performing a wide variety of athletic and recreational activities in the shorts.

2. Description of the Prior Art

The use of athletic shorts is known in the prior art. More specifically, athletic shorts heretofore devised and utilized for the purpose of clothing a user while performing athletic activities are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 4,602,388 to Underwood chafe-free athletic shorts.

U.S. Pat. No. Des. 313,692 to Karn discloses athletic shorts.

U.S. Pat. No. 5,271,101 to Speth discloses cycling shorts with anatomical seat pad.

U.S. Pat. No. 5,136,727 to Brisco discloses exercise shorts.

U.S. Pat. No. 4,310,929 to Finlay discloses reversible running shorts.

Lastly, U.S. Pat. No. Des. 266,540 to Nacinovich discloses shorts.

In this respect, the multi-sport all weather shorts according to the present invention substantially departs from the conventional concepts and designs of the prior art, and in doing so provides an apparatus primarily developed for the purpose of performing a wide variety of athletic and recreational activities in the shorts.

Therefore, it can be appreciated that there exists a continuing need for a new and improved athletic shorts with inner and outer layers which can be used for performing a wide variety of athletic and recreational activities in the shorts. In this regard, the present invention substantially fulfills this need.

SUMMARY OF THE INVENTION

In view of the foregoing disadvantages inherent in the known types of athletic shorts now present in the prior art, the present invention provides an improved athletic shorts with inner and outer layers. As such, the general purpose of the present invention, which will be described subsequently in greater detail, is to provide a new and improved athletic shorts with inner and outer layers and method which has all the advantages of the prior art and none of the disadvantages.

To attain this, the present invention essentially comprises new and improved multi-sport all weather shorts comprising, in combination: an outer shell fabricated of nylon and including an upper region, a lower region, an inner surface and an outer surface, the upper region being formed in a hollow generally cylindrical configuration with an open uppermost extent, the uppermost extent having a perimeter with a heavy duty elastic waistband formed contiguously therewith, the upper region and waistband having a front section with a vertical slit formed therein, the slit dividing the front section and waistband into first and second halves, each half including vertically positioned opposing sides of a VELCRO strip affixed adjacent to the slit, the first half being overlapped upon the second half with the VELCRO strips being releasably coupled, the front section of the waistband including an adjustable strap formed in two pieces, a first piece including an adjustment clip and being affixed to the first half of the front region, the second piece being affixed to the second half of the front region and releasably couplable to the adjustment clip, the first and second halves of the front region each including a pocket, each pocket having a vertically oriented VELCRO strip to permit releasable closure of the pocket, the upper region having a rear section including a rear pocket, the rear pocket including a horizontally oriented zipper to permit releasable closure thereof, the waistband having a rear section including two adjustable straps, each strap being formed in two releasably couplable parts; the lower region of the outer shell including two legs, each leg being formed in a generally cylindrical configuration with an open lowermost extent having a perimeter and a front section, each front section including an adjustable strap formed in two releasably couplable parts, the straps being positioned adjacent to the perimeter; and an inner sports brief fabricated of LYCRA and positioned inside the outer shell, the sports brief being smaller than and having the same shape as the outer shell, the sports brief having an uppermost extent affixed to the waistband of the outer shell, the sports brief having a front section affixed adjacent to the vertical slit of the outer shell, the sports brief having a lower section comprising two legs, each leg having an open lowermost extent with a perimeter including a NEOPRENE strip, in an operative orientation the sports brief form fitting a user's body.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved athletic shorts with inner and outer layers which has all of the advantages of the prior art athletic shorts and none of the disadvantages.

It is another object of the present invention to provide a new and improved athletic shorts with inner and outer layers which may be easily and efficiently manufactured and marketed.

It is further object of the present invention to provide a new and improved athletic shorts with inner and outer layers which is of durable and reliable constructions.

An even further object of the present invention is to provide a new and improved athletic shorts with inner and outer layers which is susceptible of a low cost of manufacture with regard to both materials and labor, and which accordingly is then susceptible of low prices of sale to the consuming public, thereby making such athletic shorts with inner and outer layers economically available to the buying public.

Still yet another object of the present invention is to provide a new and improved athletic shorts with inner and outer layers which provides in the apparatuses and methods of the prior art some of the advantages thereof, while simultaneously overcoming some of the disadvantages normally associated therewith.

Still another object of the present invention is to perform a wide variety of athletic and recreational activities in the shorts.

Lastly, it is an object of the present invention to provide new and improved athletic shorts with inner and outer layers comprising: an outer shell fabricated of synthetic materials and including an upper region formed in a cylindrical configuration with an open uppermost extent, the upper region having a front section including a vertical slit with coupling devices and an adjustable strap, the outer shell having at least one pocket including a VELCRO strip to permit releasable closure of the pocket, the lower region of the outer shell including two legs formed in a generally cylindrical configuration with an open lowermost extent having a perimeter and a front section, each front section including an adjustable strap positioned adjacent to the perimeter; and an inner sports brief fabricated of synthetic materials and positioned inside the outer shell, the sports brief being smaller than and having the same shape as the outer shell, the sports brief having an uppermost extent affixed to the uppermost extent of the outer shell, the sports brief having a lower section comprising two legs, each leg having an open lowermost extent with a perimeter including a elastic strip.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
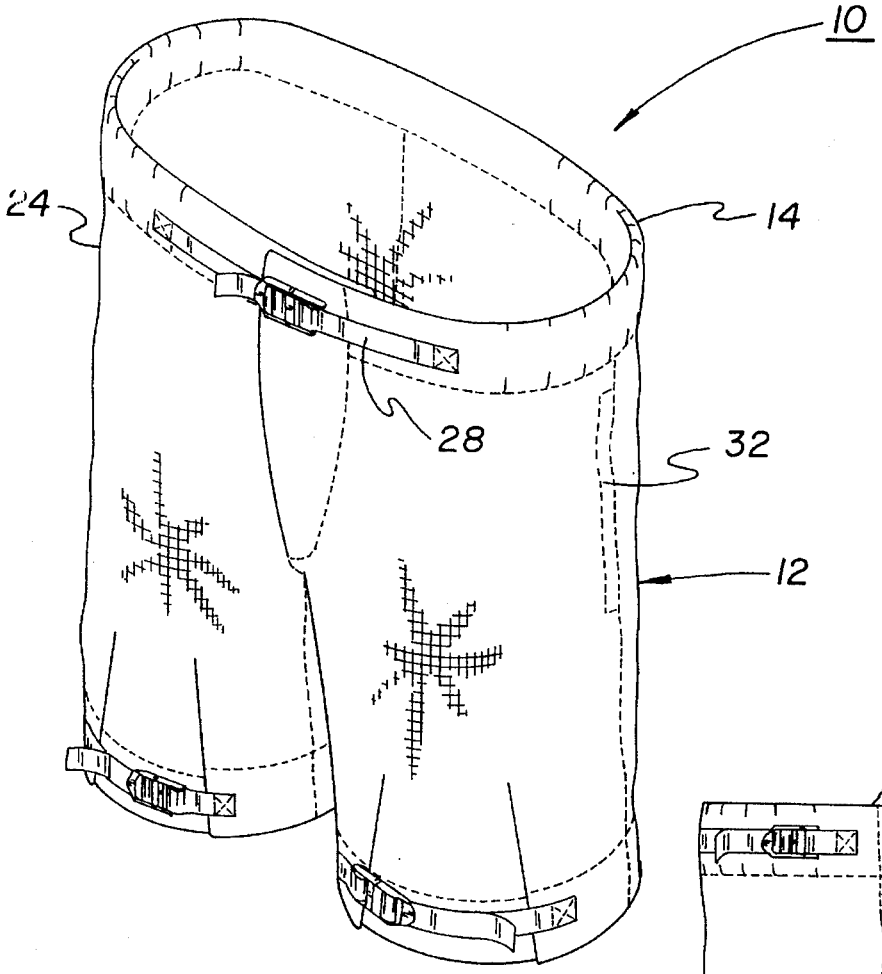
FIG. 1 is a perspective view of the preferred embodiment of the multi-sport all weather shorts constructed in accordance with the principles of the present invention.
Figure 2:
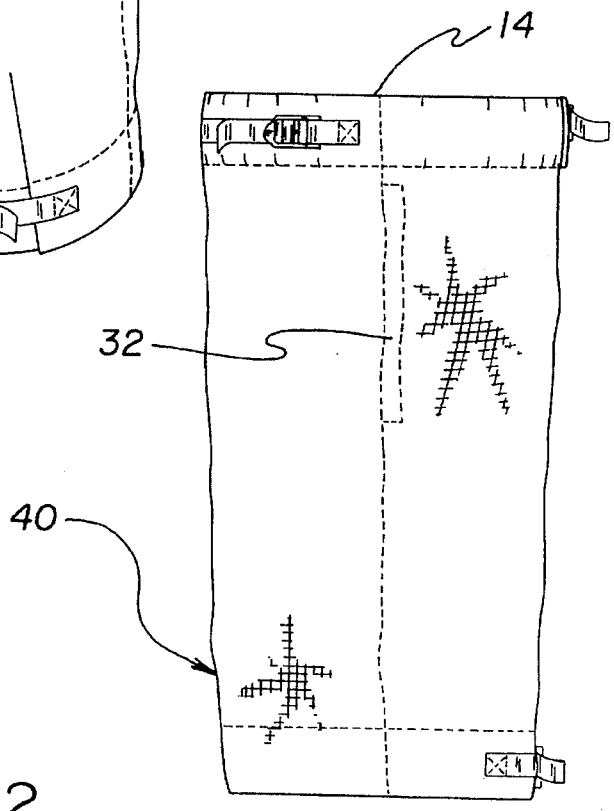
FIG. 2 is a side perspective view of the apparatus shown in FIG. 1.

With reference now to the drawings, and in particular to FIG. 1 thereof, the preferred embodiment of the new and improved athletic shorts with inner and outer layers embodying the principles and concepts of the present invention and generally designated by the reference numeral 10 will be described.

The present invention, the athletic shorts with inner and outer layers 10 is comprised of a plurality of components. Such components in their broadest context include an outer shell 12, a waistband 14, a vertical slit 16 and a inner sports brief 18. Such components are individually configured and correlated with respect to each other so as to attain the desired objective.

More specifically, the outer shell 12 is fabricated of NYLON and includes an upper region 24, a lower region, an inner surface and an outer surface. NYLON is a formable synthetic fiber commonly used as an exterior fabric. The NYLON utilized in the preferred embodiment of the apparatus is water resistant, washable and very durable. This configuration permits users to wear the shorts in many different weather conditions. The adjustable straps of the apparatus permit users to wear the shorts over other types of clothing during harsh weather conditions. In alternative embodiments of the apparatus the outer shell is fabricated of other synthetic materials. The upper region is formed in a hollow generally cylindrical configuration with an open uppermost extent. The uppermost extent has a perimeter with a heavy duty elastic waistband 14 formed contiguously within it. The outer is shell is fabricated in several different sizes to accommodate different sized users. The elastic waist band and adjustable straps permit snug fitting upon the bodies of a plurality of differently sized users. Note FIG. 1.

Figure 3:
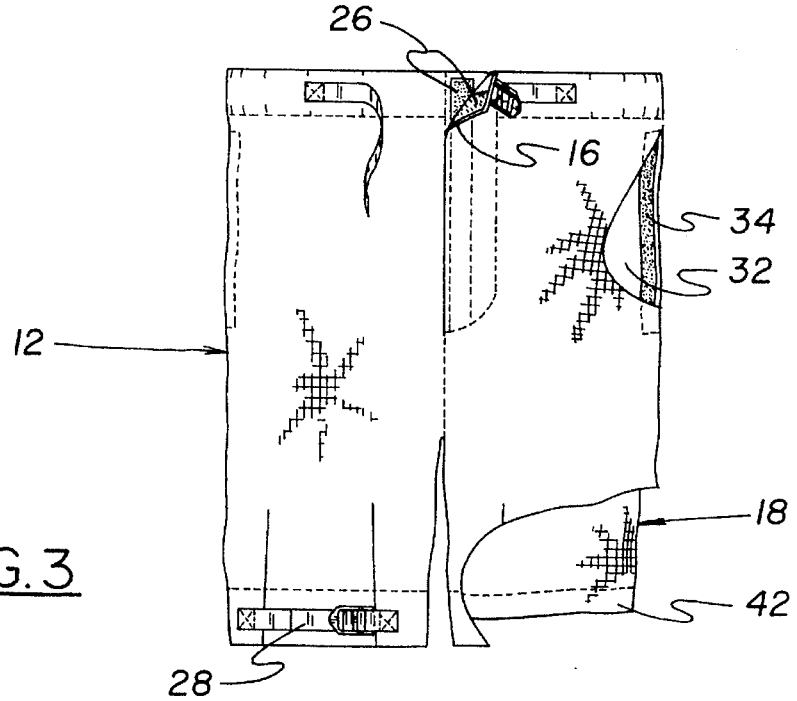
FIG. 3 is a partially broken away front perspective view of the multi-sport all weather shorts illustrating the neoprene strips of the inner sports brief.

The upper region and waistband have a front section with a vertical slit 16 formed in it. The slit divides the front section and waistband into first and second halves. Each half includes vertically positioned opposing sides of a VELCRO strip 26 affixed adjacent to the slit. The first half is overlapped upon the second half with the VELCRO strips being releasably coupled together. The easily couplable VELCRO strips provide users with an easy method of placing and removing the apparatus upon their bodies. The velcro strips are also water resistant. Note FIG. 3.

Figure 7:
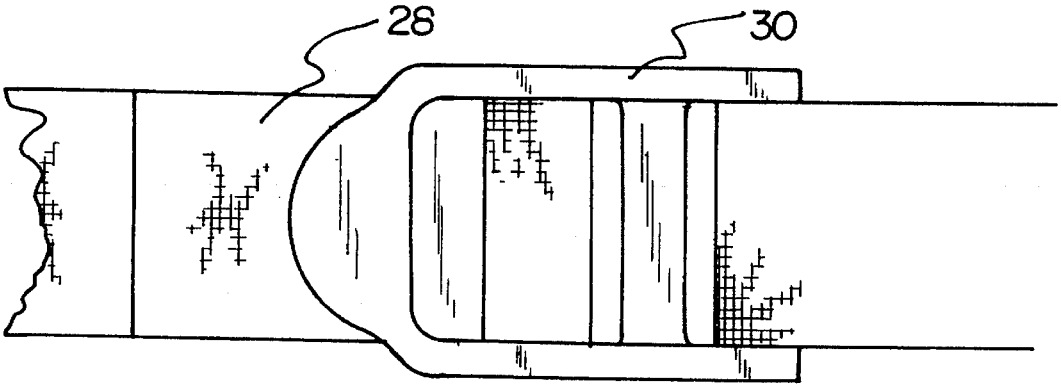
FIG. 7 is an isolated perspective view of the adjustable strap of the apparatus.

The front section of the waistband includes an adjustable strap 28 formed in two pieces. A first piece includes an adjustment clip 30 and is affixed to the first half of the front region. The second piece is affixed to the second half of the front region and is releasably couplable to the adjustment clip. The straps are fabricated of durable synthetic materials. The clips are fabricated of aluminum or plastic. Note FIGS. 1 and 7.

Figure 5:
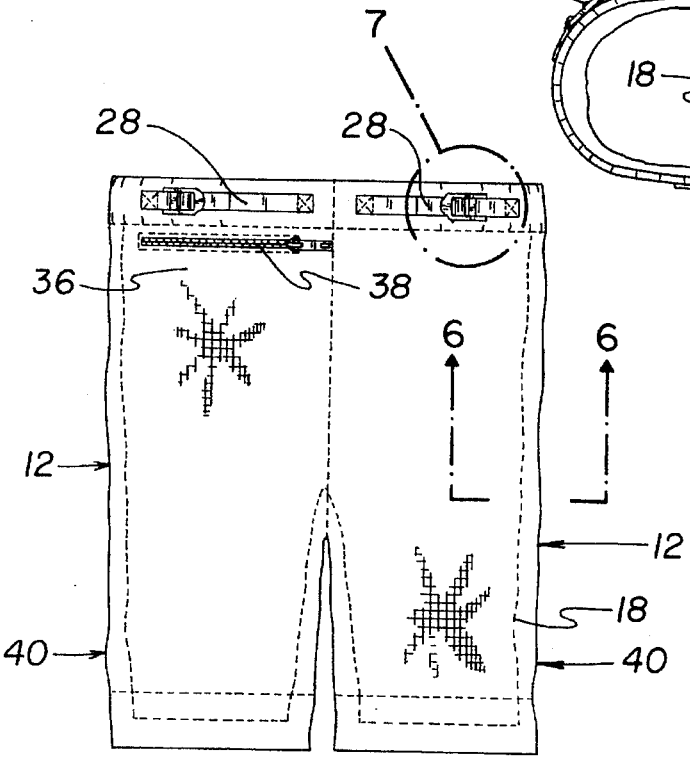
FIG. 5 is a rear perspective view of the athletic shorts with inner and outer layers illustrating the neoprene strips of the inner sports brief.

The first and second halves of the front region each include a pocket 32. Each pocket has a vertically oriented VELCRO strip 34 to permit releasable closure of the pocket. The VELCRO strip is easily couplable and water resistant. The upper region has a rear section which includes a rear pocket 36. The rear pocket includes a horizontally oriented zipper 38 to permit releasable closure. The waistband has a rear section which includes two adjustable straps 28. Each strap is formed in two releasably couplable parts. The front and rear straps enable users to uniformly tighten the apparatus their wastes. Note FIG. 5.

Figure 4:
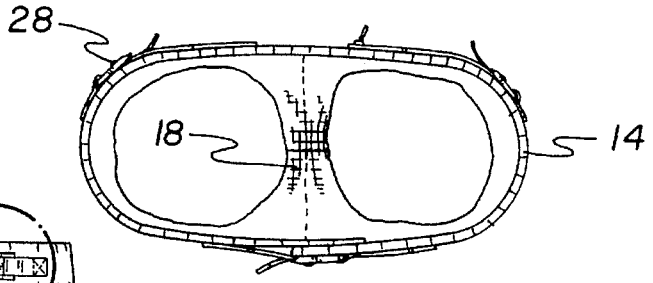
FIG. 4 is a top perspective view of the athletic shorts with inner and outer layers illustrating the inner sports brief of the apparatus.

The lower region of the outer shell includes two legs 40. Each leg is formed in a generally cylindrical configuration with an open lowermost extent having a perimeter and a front section. Each front section includes an adjustable leg strap 28 formed in two releasably couplable parts. The leg straps are positioned adjacent to the perimeter of each leg. The leg straps enable users to uniformly tighten the apparatus to their legs. The waist and leg straps help prevent the entry of water, snow and dirt into the outer shell. Note FIGS. 3–5.

Figure 6:
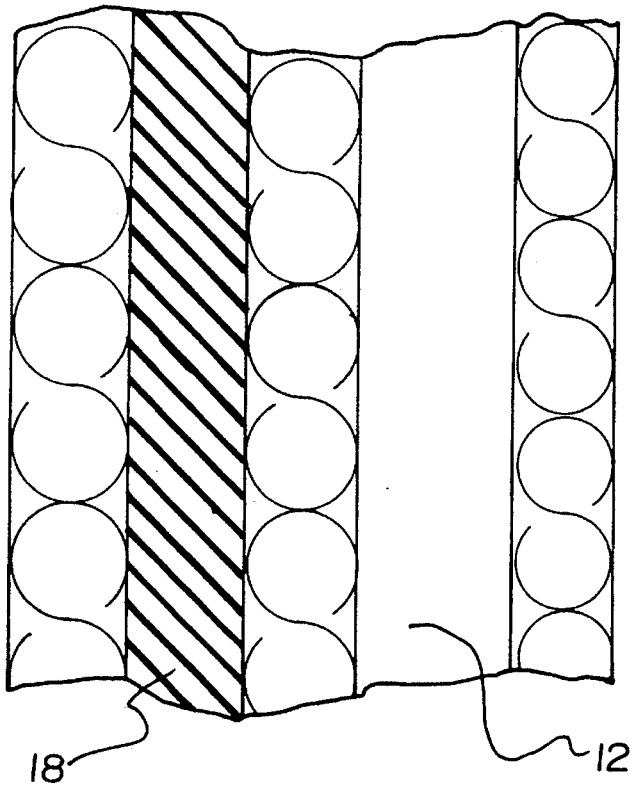
FIG. 6 is a cross sectional view of the apparatus taken along section line 6—6 of FIG. 5.

An inner sports brief 18 is fabricated of LYCRA and positioned inside the outer shell. The sports brief is smaller than the outer shell and having the same shape as the outer shell. The sports brief has an uppermost extent affixed to the waistband of the outer shell. The sports brief has a front section which is affixed adjacent to the vertical slit of the outer shell. The sports brief has a lower section comprising two legs. Each leg has an open lowermost extent with a perimeter including a NEOPRENE strip 42. The NEOPRENE strip provides a snug fit around a user's leg. In an operative orientation the sports brief form fits a user's body. The brief provides comfort and support to users around the genital region. Note FIGS. 3, 4 and 6.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. Athletic shorts with inner and outer layers comprising, in combination:

an outer shell fabricated of nylon and including an upper region, a lower region, an inner surface and an outer surface, the upper region being formed in a hollow generally cylindrical configuration with an open uppermost extent, the uppermost extent having a perimeter with a heavy duty elastic waistband formed contiguously therewith, the upper region and waistband having a front section with a vertical slit formed therein, the slit dividing the front section and waistband into first and second halves, each half including vertically positioned opposing sides of a hook and loop fastener strip affixed adjacent to the slit, the first half being overlapped upon the second half with the hook and loop fastener strips being releasably coupled, the front section of the waistband including an adjustable strap formed in two pieces, a first piece including an adjustment clip and being affixed to the first half of the front section, the second piece being affixed to the second half of the front section and releasably couplable to the adjustment clip, the first and second halves of the front section each including a pocket, each pocket having a vertically oriented hook and loop fastener strip to permit releasable closure of the pocket, the upper region having a rear section including a rear pocket, the rear pocket including a horizontally oriented zipper to permit releasable closure thereof, the waistband having a rear section including two adjustable straps, each strap being formed in two releasably couplable parts;

the lower region of the outer shell including two legs, each leg being formed in a generally cylindrical configuration with an open lowermost extent having a perimeter and a front section, each front section including an adjustable strap formed in two releasably couplable parts, the straps being positioned adjacent to the perimeter; and an inner sports brief fabricated of spandex and positioned inside the outer shell, the sports brief being smaller than and having the same shape as the outer shell, the sports brief having an uppermost extent affixed to the waistband of the outer shell, the sports brief having a front section affixed adjacent to the vertical slit of the outer shell, the sports brief having a lower section comprising two legs, each leg having an open lowermost extent with a perimeter including a NEOPRENE strip, in an operative orientation the sports brief form fitting a user's body.

2. Athletic shorts with inner and outer layers comprising:

an outer shell fabricated of synthetic materials and including an upper region formed in a cylindrical configuration with an open uppermost extent, the upper region having a front section including a vertical slit with coupling devices and an adjustable strap, the outer shell having at least one pocket including a hook and loop fastener strip to permit releasable closure of the pocket, the lower region of the outer shell including two legs formed in a generally cylindrical configuration with an open lowermost extent having a perimeter and a front section, each front section including an adjustable strap positioned adjacent to the perimeter; and an inner sports brief fabricated of synthetic materials and positioned inside the outer shell, the sports brief being smaller than and having the same shape as the outer shell, the sports brief having an uppermost extent affixed to the uppermost extent of the outer shell, the sports brief having a lower section comprising two legs, each leg having an open lowermost extent with a perimeter including a elastic strip, in an operative orientation the sports brief form fitting a user's body.

3. The athletic shorts with inner and outer layers as set forth in claim 2 wherein the uppermost extent of the upper region has a perimeter including a heavy duty elastic waistband.

4. The athletic shorts with inner and outer layers as set forth in claim 2 wherein the outer shell is fabricated of NYLON, the inner sports brief is fabricated of spandex, and the elastic strip on each leg of the inner sports brief is fabricated of NEOPRENE.

5. The athletic shorts with inner and outer layers as set forth in claim 2 wherein the coupling devices on each of the slits are hook and loop fastener strips.

* * * * *